US006307459B1

(12) United States Patent
Yu

(10) Patent No.: US 6,307,459 B1
(45) Date of Patent: Oct. 23, 2001

(54) POWER SWITCH DEVICE

(76) Inventor: Tsung-Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 0 days.

(21) Appl. No.: 09/477,651

(22) Filed: Jan. 5, 2000

(51) Int. Cl.[7] ..... H01H 37/02; H01H 37/32; H01H 37/96

(52) U.S. Cl. ..... 337/37; 337/39; 337/59; 337/8.5; 337/112; 337/113; 337/66; 337/74

(58) Field of Search ..... 337/333, 379, 337/79, 59, 66, 76, 53, 67–69, 74, 75, 91, 39, 85, 112, 113, 140, 334, 345; 200/553–557

(56) References Cited

U.S. PATENT DOCUMENTS

| | | | | |
|---|---|---|---|---|
| 3,358,099 | * | 12/1967 | Bellomayre | 200/113 |
| 4,258,349 | * | 3/1981 | Flory | 337/46 |
| 4,345,233 | * | 8/1982 | Matthies | 337/75 |
| 4,528,538 | * | 7/1985 | Andersen | 337/43 |
| 4,931,762 | * | 6/1990 | Fierro | 337/66 |
| 5,012,495 | * | 4/1991 | Munroe et al. | 37/0 |
| 5,262,748 | * | 11/1993 | Tsung-Mou | 337/66 |
| 5,451,729 | * | 9/1995 | Onderka et al. | 200/18 |
| 5,541,569 | * | 7/1996 | Jang | 337/68 |
| 5,760,672 | * | 6/1998 | Wang | 337/79 |
| 5,828,284 | * | 10/1998 | Huang | 337/37 |
| 5,847,638 | * | 12/1998 | Sorenson | 337/380 |
| 5,889,457 | * | 3/1999 | Hsu et al. | 337/59 |
| 5,892,426 | * | 4/1999 | Huang | 337/59 |
| 5,898,355 | * | 4/1999 | Yu | 337/8 |
| 6,072,381 | * | 6/2000 | Yu | 337/37 |
| 6,094,126 | * | 7/2000 | Sorenson | 337/37 |
| 6,121,868 | * | 9/2000 | Chiang | 337/37 |
| 6,154,116 | * | 11/2000 | Sorenson | 337/37 |

FOREIGN PATENT DOCUMENTS

| | | | | |
|---|---|---|---|---|
| 647094-A5 | * | 12/1984 | (CH) | 337/333 |
| 19534611-A1 | * | 3/1996 | (DE) | H01H/23/20 |
| 0694947-A1 | * | 1/1996 | (EP) | H01H/71/54 |

* cited by examiner

*Primary Examiner*—Leo P. Picard
*Assistant Examiner*—Anatoly Vortman

(57) ABSTRACT

A switch structure comprises a control element, which comprises an alloy piece and a swing contact device. The alloy piece includes an actuating piece with a convex part, which has a upper side normally pushing the lower surface of the end part in the swing contact device so that the actuating piece ejects outwards and escapes from the end part when the alloy piece is overheated because of the current flowing through therein overloaded. Therefore, the end part falls down due to no support force and the head part of the swing contact device deforms upwards and does not press on the elastic contact piece. The elastic contact piece is released from the pressing of the swing contact device to eject upwards. Two joints connected in an electric loop are tripped. The object of rapid response, cutting power source, and safety is therefore achieved.

14 Claims, 6 Drawing Sheets

POWER SWITCH DEVICE

FIELD OF THE INVENTION

The present invention relates to a switch structure, and more specifically, to a power switch with a simpler structure that is capable of switching off the power source when the current is overloaded.

BACKGROUND OF THE INVENTION

Power switches with only two states of ON and OFF functions controlled manually have been widely used in many appliances. However, it is risky to use the above power switches when the power source is unstable because overheating may occur due to overloading of the appliance and the wire easily catches fire. The users can not be aware of such latent danger since overloading and overheating are invisible. Therefore, such improved power switches have been greatly needed to overcome the danger.

Some improved power switch of the prior arts includes an alloy element composed of more than one metal to automatically shut off the power source when the alloy element is thermally deformed because of overheating.

For example, the power switch disclosed in in the prior art includes an alloy piece, a lever, and a cam actuator. The lever is actuated by the alloy piece, and the cam actuator is used to coordinate with a seesaw actuator. Thermal deformation of the alloy piece causes the lever to move, and then the cam actuator loses support, escapes and further cuts off the power source. Overheating may occur on he alloy piece. The above power switch uses the lever, the cam actuator, and the seesaw actuator to indirectly control the conductive plate, which is used to contact with the power source. The response of the power off operation in the above power switch when overheating occurs is so slow that the overloaded current may flow into the operating appliance in a short time to damage the appliance. Additionally, the conductive plate and the alloy piece need the wire to connect to each other, and the whole structure is complicated to cause the manufacturing difficult. The alloy piece has to actuate the seesaw actuator and the lever to escape. The function of automatic power off may incorrectly operate.

Furthermore, the power switch disclosed in U.S. Pat. No. 5,786,742 uses the thermal deformation of the alloy piece to push a limited position base such that a button can automatically escape and return back. The button is used to directly contact with the contact point of the power source so that the button may conduct the overloaded current when overheating occurs. The whole structure is still complicated. In summary, those improved power switches in the prior arts can partly overcome the danger of overheating for the appliance but the response is slow and the whole structure is complicated. An advanced power switch with simpler structure and a short response time is greatly desired.

SUMMARY OF THE INVENTION

An object of the present invention is to provide a switch structure comprising a control element, which consists of an alloy piece and a swing contact device. The alloy piece includes an actuating piece with a convex part, which has a upper side normally pushing the lower surface of the end part in the swing contact device so that the actuating piece ejects outwards and escapes from the end part when the alloy piece is overheated because the current flowing through the alloy piece is overloaded. Therefore, the end part falls down due to no support force and the head part of the swing contact device deforms upwards and does not press on the elastic contact piece. The elastic contact piece is released from the pressing of the swing contact device to eject upwards. Two joints connected in an electric loop are tripped. The object of rapid response, cutting power source, and safety is therefore achieved.

Other features and advantages of the invention will become apparent from the following description of the invention that refers to the accompanying drawings.

DETAILED DESCRIPTION OF THE PREFERRED EMBODIMENTS

Figure 1:
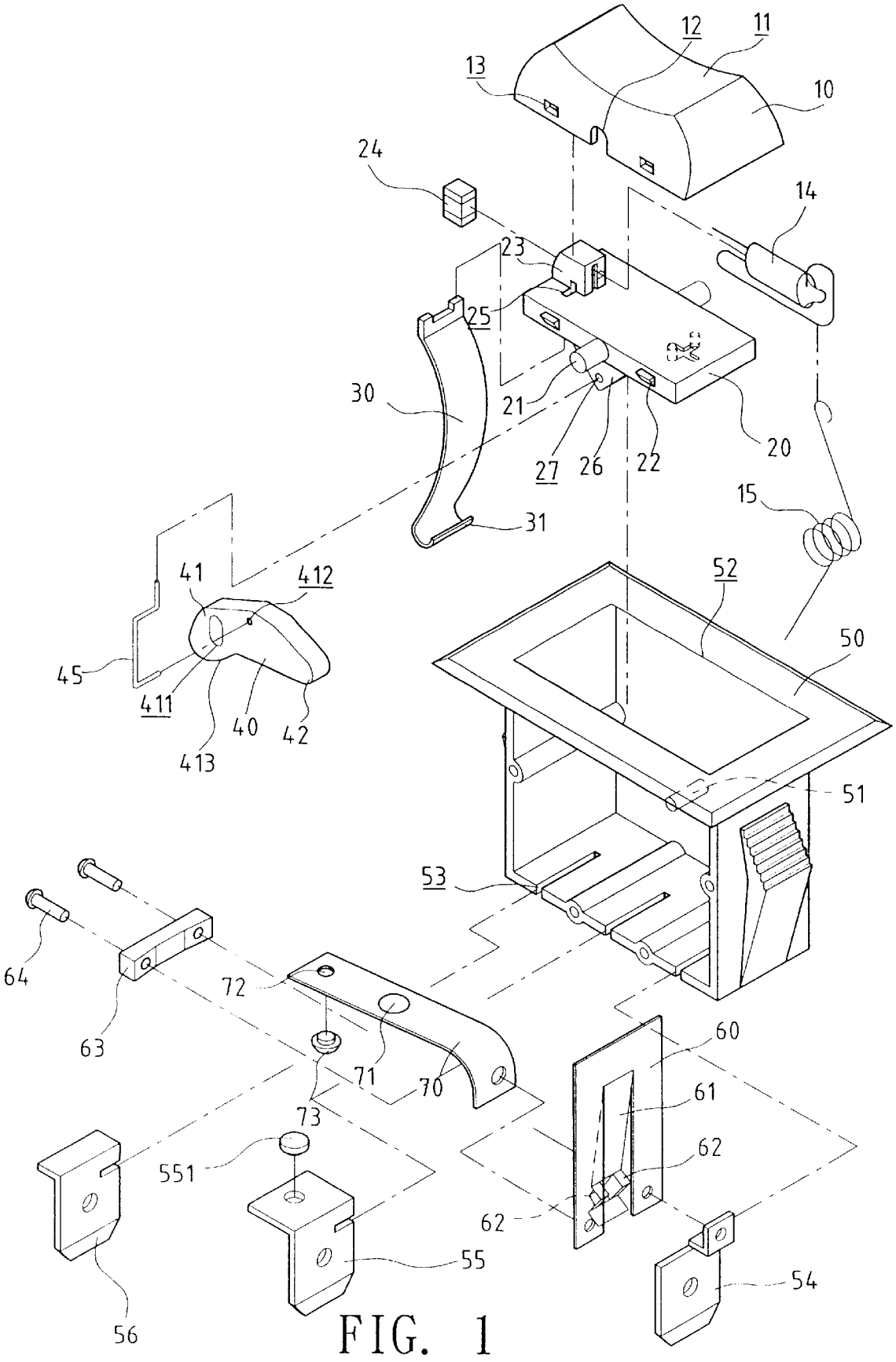
FIG. 1 shows the exploded diagram of the switch structure according to the present invention.

With reference to FIG. 1, the exploded diagram of the present invention shows that the switch structure comprises a switch cover body 10, a contact reed 30, a switch contact device 40, a switch body 50, an alloy piece 60, and an elastic contact piece 70. The switch cover body 10 is combined with a switch seat 20 and has a concave cambered surface 11. Two axial holes 12 and two buckle holes 13 are formed on the two sides of the switch cover body 10. Two fulcrums 21 and two tenons 22 on the switch seat 20 respectively correspond to the two axial holes 12 and two buckle holes 13 so as to joint with the switch cover body 10. Accordingly, the switch cover body 10 may rotate around the fulcrums 21 clockwise or counterclockwise by external force applied. A resistor seat 23 included in the switch seat 20 comprises a chip resistor 24 to serve as a current limiting resistor for the neon lamp 14, which is used to indicate the ON state of the switch. The resistor seat 23 has two through holes 25 on both sides. The switch seat 20 further includes a triangular piece 26, which has a supporting rod hole 27.

The contact reed 30 has one end inserting through the through holes 25 and connects to the chip resistor 24. Another end forms a hook 31 hooking the third contact terminal 56 of the switch contact device 40 to electrically connect to one pin of the neon lamp 14 and eject the switch cover body 10 if desired.

The switch contact device 40 is wide at the head part 41 and becomes narrower towards the end part 42. The head part 41 has an elliptical slot hole 411 and a through hole 412. The slot hole 411 is used to connect the switch contact device 40 to the convex pillar 51 on the switch body 50. A supporting rod 43 penetrates through the through hole 412 and the supporting rod hole 27 of the switch seat 20 so that the switch contact device 40 may act with the switch cover body 10. Additionally, the head part 41 has a convex part 413 at the bottom.

The switch body 50 forms a hollow body with an opening 52 on the top, which is connected with the switch cover body 10. The bottom of the switch body 50 forms a plurality of slots 53 to contact with the first contact terminal 54, the second contact terminal 55, and the third contact terminal 56.

The alloy piece 60 has a shape of U. An actuating piece 61 with a convex part 62 at the bottom is formed at the central region of the alloy piece 60. The actuating piece 61 and the alloy piece 60 forms an appropriate angle.

The elastic contact piece 70 has a round convex part 71 on the top, which comprises a contact hole 72 at the front end to joint with the upper contact terminal 73.

The above elastic contact piece 70 is combined with one pin of the alloy piece 60 by the fixing base 63 and the rivet 64. Another pin of the alloy piece 60 is fixed to he first contact terminal 54 so that the elastic contact piece 70 is located over the second contact terminal 55 and the third contact terminal 56.

Furthermore, the second contact terminal 55 has a lower contact terminal 551 at the top to connect the elastic conductive device 15 to another pin of the neon lamp 14 so as to form a complete electrical loop.

The action of the switch according to the present invention includes OFF, ON, and trip when the current is overloaded. The detail will be described in the following.

Figure 2:
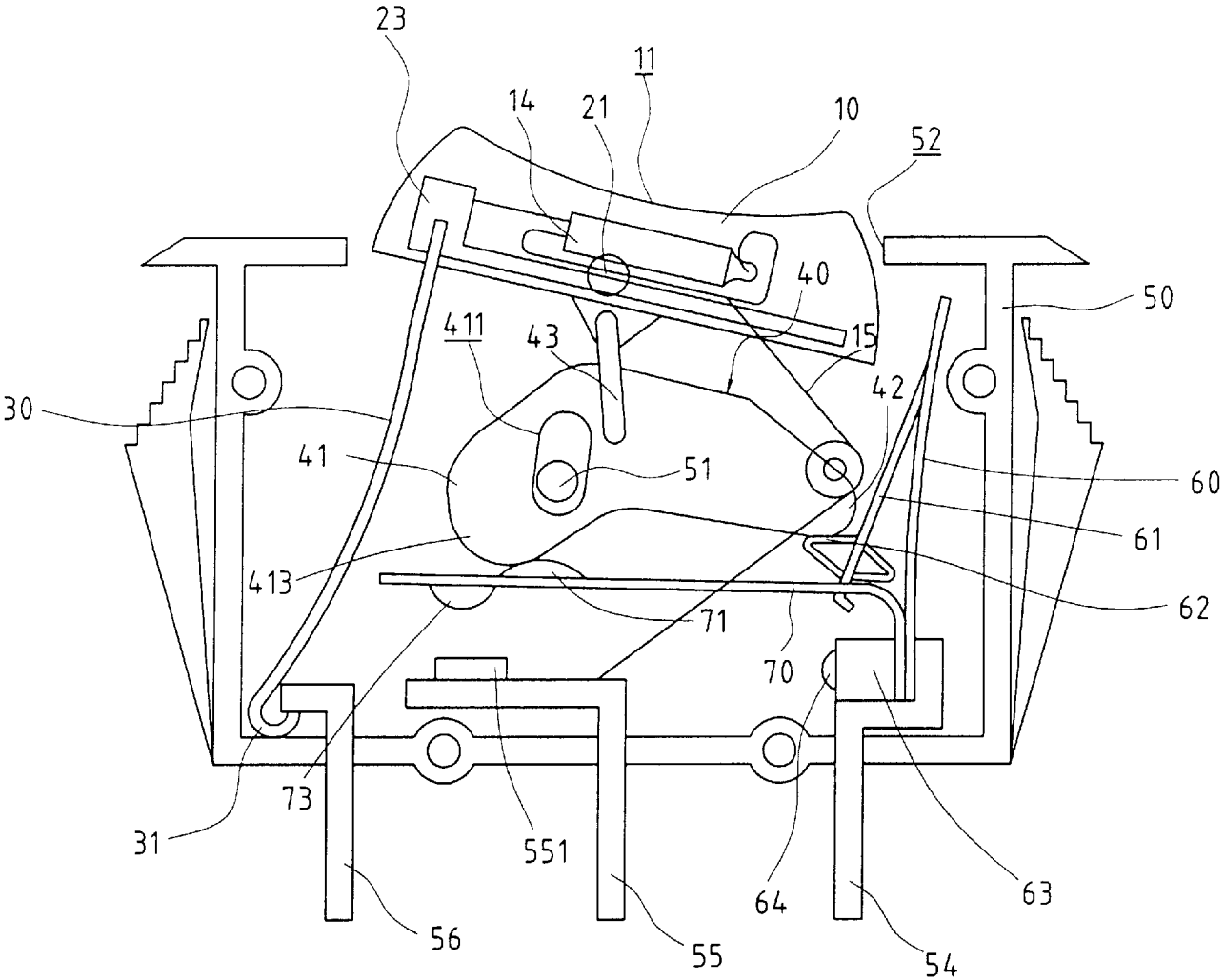
FIG. 2 is a sectional view of the switch structure illustrating the ON state of the switch structure according to the present invention.

With reference to FIG. 2, the OFF state of the present invention or the OFF state performed by the user is illustrated. When the user presses the switch cover body 10, the contact reed 30 spreads and the switch cover body 10 rotates around the fulcrum 21 clockwise because the switch cover body 10 and the switch seat 20 are combined. Therefore, the supporting rod hole 27 also rotates around the fulcrum 21 clockwise as arc motion (left in this embodiment). The top end of the supporting rod 43 moves up left to pull up the head part 41 of the switch contact device 40 so that the elastic contact piece 70 ejects upwards without the pressing of the switch contact device 40. The upper contact terminal 73 escapes from the lower contact terminal 551 to disconnect the first contact terminal 54 and the second contact terminal 55, thereby cut off the power source. The neon lamp 14 thus turns off without power applied from the second contact terminal 55.

Figure 3:
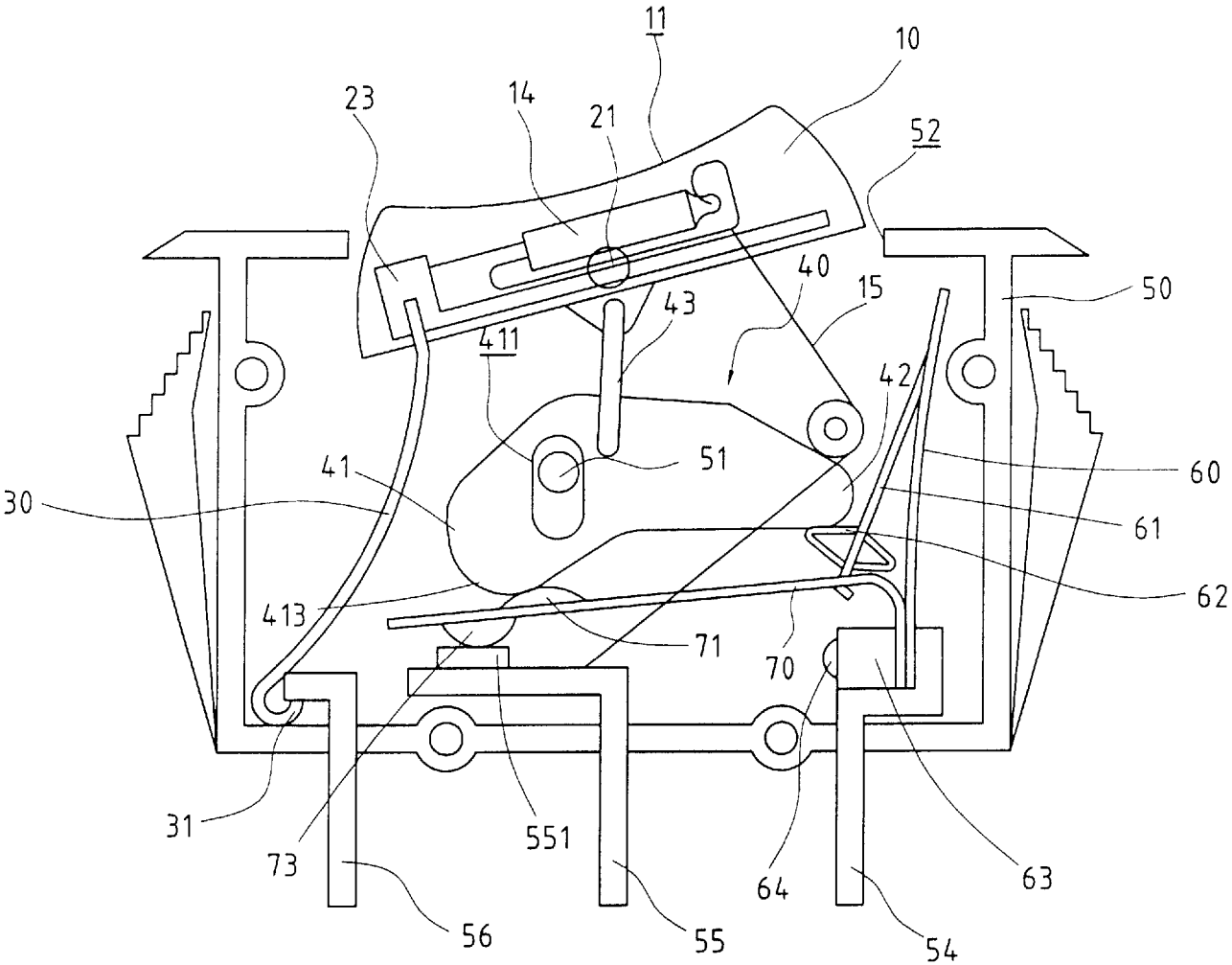
FIG. 3 is a sectional view illustrating the OFF state of the switch structure according to the present invention.

As shown in FIG. 3, the ON state of the present invention is illustrated. When the user presses the left of the switch cover body 10, the contact reed 30 is deformed and the switch cover body 10 rotates around the fulcrum 21 counterclockwise because the switch cover body 10 and the switch seat 20 are combined. Therefore, the supporting rod hole 27 also rotates around the fulcrum 21 counterclockwise as arc motion (right in this embodiment). The top end of the supporting rod 43 moves down left so that the head part 41 of the switch contact device 40 moves downwards. The bottom edge of the end part 42 in the switch contact device 40 pushes the top side of the convex part 62 of the actuating piece 61. The convex part 413 rotates downwards around the end part 42 to push the round convex part 71. The elastic contact piece 70 is thus pressed down so that the upper contact terminal 73 on the bottom side of the elastic contact piece 70 contacts the lower contact terminal 551 of the second contact terminal 55. The external power source is supplied from the first contact terminal 54, the alloy piece 60, the elastic contact piece 70, the upper contact terminal 73, the lower contact terminal 551, and the second contact terminal 55 to form a complete electrical loop.

Moreover, after the above electrical loop is connected, the power is conducted to one pin of the neon lamp 14 through the elastic conductive device 15. Another pin of the neon lamp 14 is connected to the third contact terminal 56 through the chip resistor 24, the contact reed 30 to form an electrical loop so as to turn on the neon lamp 14 to indicate that the switch is ON.

Figure 4:
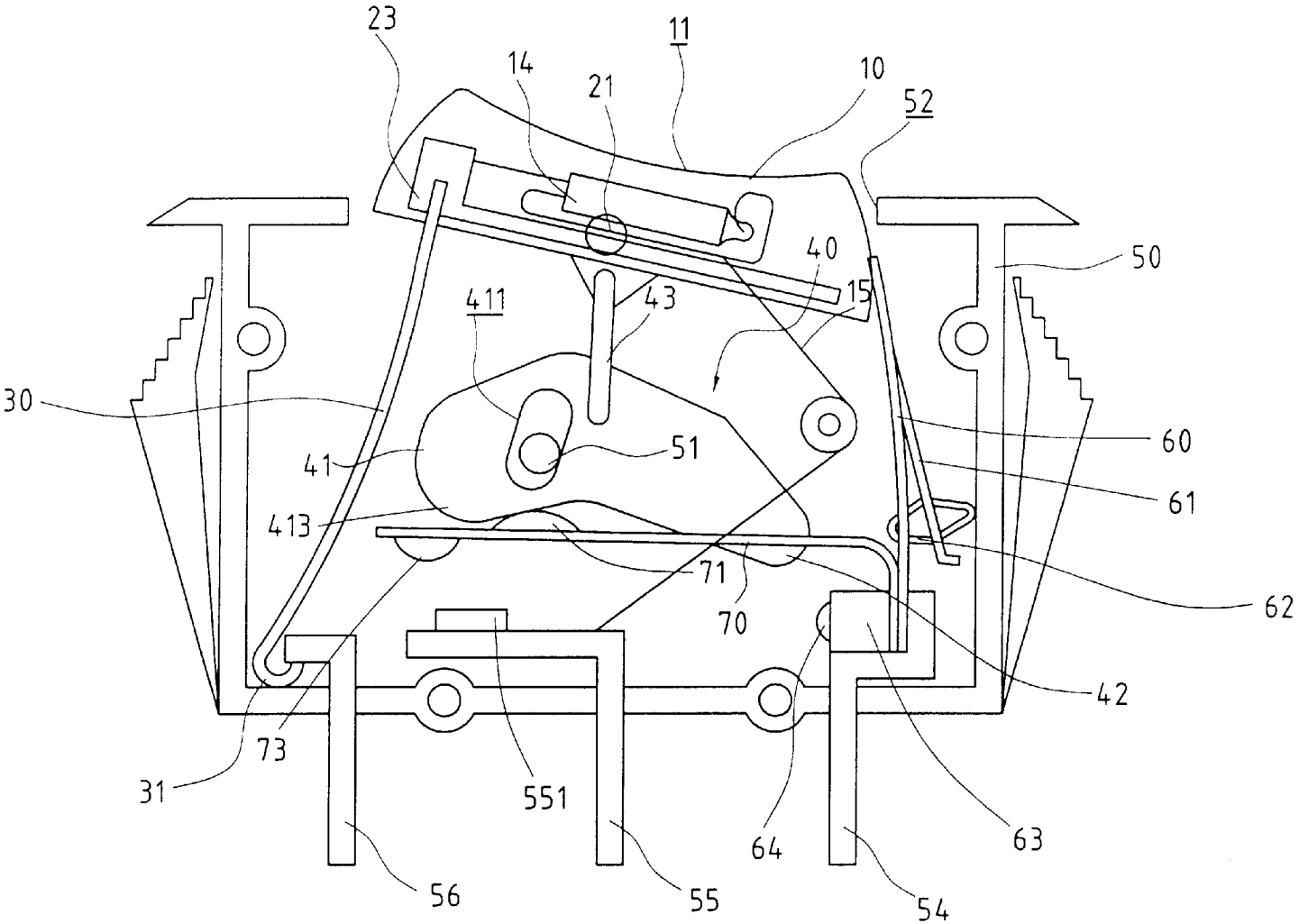
FIG. 4 is a sectional view illustrating the operation of the switch structure according to the present invention when the current is overloaded.

The switch contact device 40 swings upwards and downwards within the slot hole 411 with respect to the convex pillar 51, as shown in FIGS. 2, 3, and 4. It should be noted that in the above OFF state and ON state, the bottom edge of the end part 42 of the switch contact device 40 pushes the top side of the convex part 62 of the actuating piece 61 without any motion.

With reference to FIG. 4, the schematic diagram illustrates the action for overloaded situation. When the current is overloaded, the alloy piece 60 thermally deforms due to the heat generated by the current and bend towards the switch contact device 40. The actuating piece 61 ejects to the opposite direction and the end part 42 does not supported by the top side of the convex part 62 so as to fall down. The head part 41 of the switch contact device 40 moves upwards and the end part 42 downwards. The convex part 413 does not presses the round convex part 71 so that the elastic contact piece 70 can eject upwards to separate the upper contact terminal 73 and the lower contact terminal 551 to cut off the power source.

If the switch cover body 10is not applied by any external force, the contact reed 30 spreads and the switch cover body 10 moves upwards so that the switch cover body 10 rotates around the fulcrum 21 clockwise towards the OFF position (as shown in FIG. 2). The end part 42 of the switch contact device 40 is pulled up as the supporting rod 43 moves upwards. The circuit is open-circuited. The alloy piece 60 and the actuating piece 61 gradually cool down to return to the original state, i.e., the actuating piece 61 resiles left and the end part 42 of the switch contact device 40 again inserts into the top side of the convex part 62 of the actuating piece 61 to prepare for the next switch operation.

Figure 5:
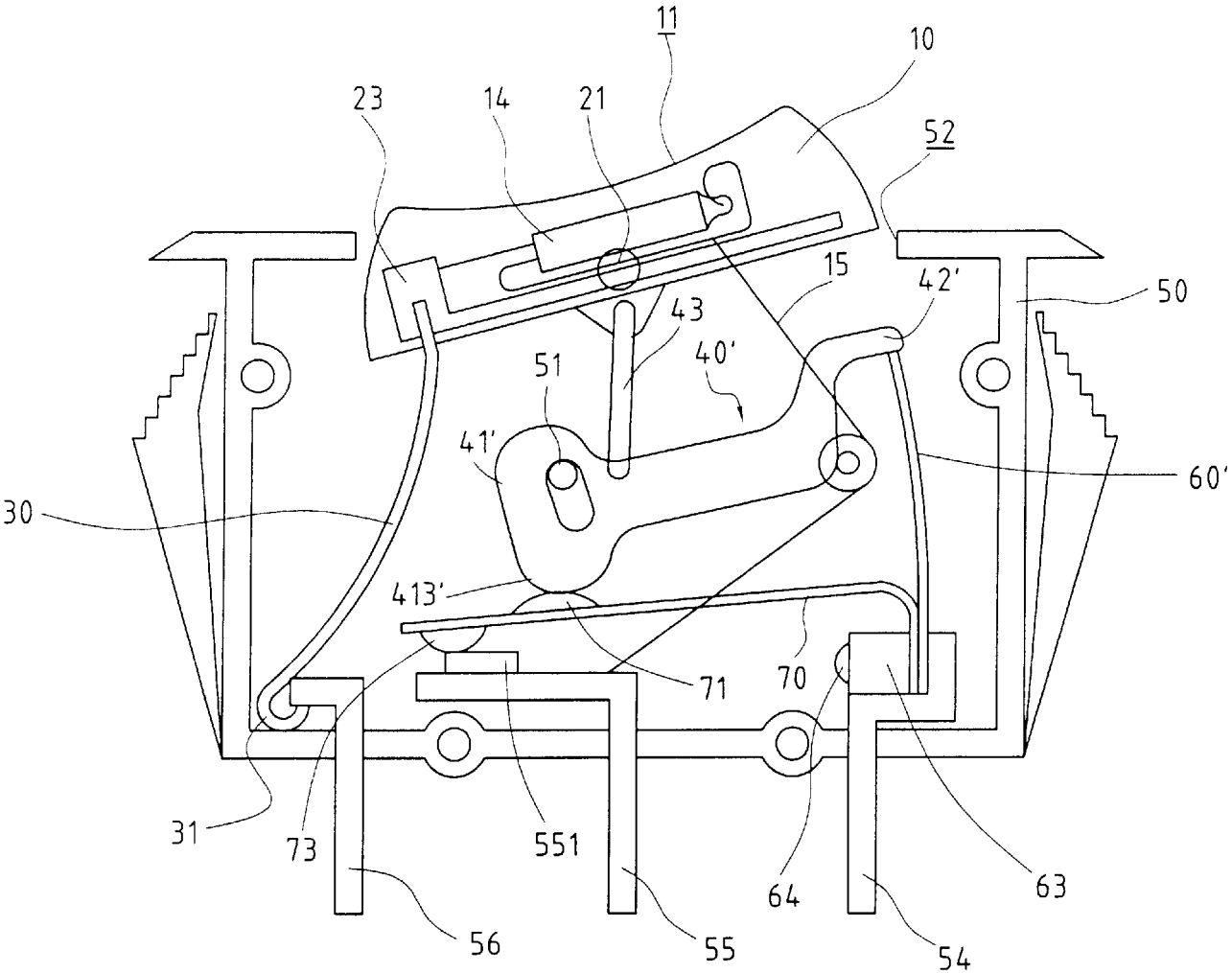
FIG. 5 is a sectional view of another embodiment illustrating the ON state of the switch structure according to the present invention.

Further referring to FIG. 5, another embodiment of the present invention provides another type of the switch contact device 40'. The switch contact device 40' comprises the head part 41' and the convex part 413' at one end. Another end bends upwards to form an end part 42'. In the embodiment, the alloy piece 60' approximately has a U shape and the end part 42' pushes the top end of the alloy piece 60'.

Figure 6:
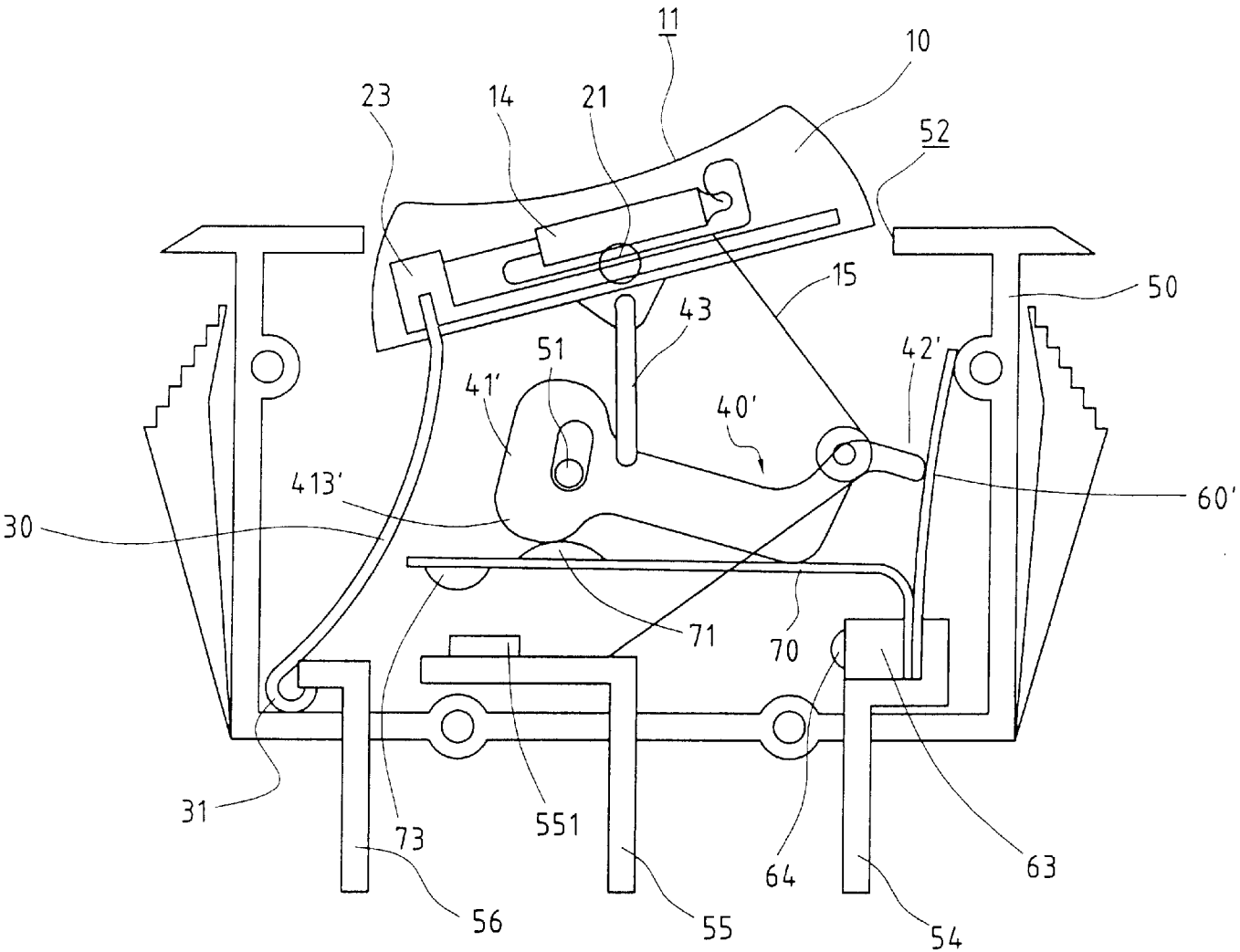
FIG. 6 is a sectional view of another embodiment illustrating the operation of the switch structure according to the present invention when the current is overloaded.

As shown in FIG. 6, the schematic diagram illustrates the action for overloaded situation in this embodiment. When the current is overloaded, the alloy piece 60' thermally deforms due to the heat generated by the current and bend towards the switch contact device 40'. The end part 42' does not supported by the top side of the actuating piece 61' so as to fall down. The head part 41' of the switch contact device 40' moves upwards and the end part 42' downwards. The convex part 413' does not presses the round convex part 71' so that the elastic contact piece 70 can smoothly eject upwards to separate the upper contact terminal 73 and the lower contact terminal 551 to cut off the power source.

From the above description, the switch contact device 40(or 40') and the alloy piece 60(or 60') are used to rapidly respond to the status of overloaded current so that the elastic contact piece 70 ejects to cut off the power source. Then the switch can automatically recover to the open state under overloaded current. The response of the present invention is rapid and the structure is simple without any error operation.

Although only the preferred embodiments of this invention were shown and described in the above description, it is requested that any modification or combination that comes within the spirit of this invention be protected.

What is claimed is:

1. A switch structure, comprising a switch body, a switch cover body, an elastic contact reed, a swing contact device, an alloy piece, an elastic contact piece, herein said switch body is installed with a convex pillar, and said switch cover body joints with said elastic contact reed and said swing contact device, and is installed with said alloy piece and said elastic contact piece, which are constructed and assembled in said switch body, wherein said swing contact device has a head part and an end part, said head part comprising a slot hole to joint with said convex pillar in the switch body to swing, said swing contact device further having a through hole to connect to said switch cover body by a supporting rod;

said alloy piece is installed with an integrally formed actuating part having a convex part, said actuating part and said alloy piece forming an appropriate angle;

said alloy piece being overheated and bent towards said swing contact device under overload current, wile said actuating part ejects in opposite direction so that the end part falls down without supporting of the convex part of the actuating part, the head part moves upwards and the end part downwards, the elastic contact reed is not pressed by the swing contact device and smoothly ejects upwards, and meanwhile, two contact terminals which construct an electric loop become separated to cut off a power source.

2. A switch structure, comprising:

a switch body, which has an opening at a top side, is installed with a convex pillar at an appropriate place within an internal side wall, and comprises a plurality of slots at a bottom side to respectively connect to a first and a second contact terminals, wherein said second contact terminal has a lower contact;

a switch cover body, combining a switch seat, which comprises a supporting rod hole at a bottom side;

a contact reed, installed between the switch seat and the switch cover body to provide elastic force for the switch cover body to eject, a swing contact device, which comprises a head part and an end part, said head part having a slot hole to joint with said convex pillar of the switch body to swing, a through hole in said swing contact device used to connect to said supporting rod hole of the switch cover body by a supporting rod;

an alloy piece, installed with an integrally formed actuating part, said actuating part and said alloy piece forming an appropriate angle; and an elastic contact piece, located over said first and said second contact terminals and having an upper contact at a bottom side.

3. The switch structure as claimed in claim 2, wherein said actuating part further comprises a convex part to support the end part of the swing contact device.

4. A switch structure, comprising:

a switch body, which has an opening at a top side, is installed with a convex pillar at an appropriate place within an internal side wall, and comprises a plurality of slots at a bottom side to respectively connect to a first and a second contact terminals, wherein said second contact terminal has a lower contact;

a switch cover body, combining a switch seat, which comprises a supporting rod hole at a bottom side;

a contact reed, installed between the switch seat and the switch cover body to provide elastic force for the switch cover body to eject;

an alloy piece, thermally deformed toward one direction;

a swing contact device, which comprises a head part and an end part, said head part having a slot hole to joint with said convex pillar of the switch body to swing, a through hole in said swing contact device used to connect to said supporting rod hole of the switch cover body by a supporting rod, said end part bending and extending upwards from another side of the head part to push a top side of said alloy piece; and an elastic contact piece, located over said first and said second contact terminals and having a upper contact at a bottom side.

5. The switch structure as claimed in claim 2, wherein said switch seat comprises a resistor base at one side, in which a chip resistor is installed and contacts with said elastic contact reed.

6. The switch structure as claimed in claim 4, wherein said switch seat comprises a resistor base at one side, in which a chip resistor is installed and contacts with said elastic contact reed.

7. The switch structure as claimed in claim 2, wherein said switch cover body is installed with a neon lamp.

8. The switch structure as claimed in claim 4, wherein said switch cover body is installed with a neon lamp.

9. The switch structure as claimed in claim 7, wherein one pin of said neon lamp connects to said chip resistor which is connected to said third contact terminal through the elastic contact reed, and another pin of said neon lamp connects to said second contact terminal through an elastic conductive element.

10. The switch structure as claimed in claim 8, wherein one pin of said neon lamp connects to said chip resistor which is connected to said third contact terminal through the elastic contact reed, and another pin of said neon lamp connects to said second contact terminal through an elastic conductive element.

11. The switch structure as claimed in claim 2, wherein said head part of said swing contact device comprises a convex part.

12. The switch structure as claimed in claim 4, wherein said head part of said swing contact device comprises a convex part.

13. The switch structure as claimed in claim 2, wherein elastic contact piece comprises a round convex part facing said convex part of said head part of said swing contact device.

14. The switch structure as claimed in claim 4, wherein elastic contact piece comprises a round convex part facing said convex part of said head part of said swing contact device.

* * * * *